US008185028B2

(12) United States Patent
Lee

(10) Patent No.: US 8,185,028 B2
(45) Date of Patent: May 22, 2012

(54) IMAGE FORMING APPARATUS AND AUTO COLOR REGISTRATION METHOD THEREOF

(75) Inventor: Ho-il Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 396 days.

(21) Appl. No.: 12/582,209

(22) Filed: Oct. 20, 2009

(65) Prior Publication Data

US 2010/0178083 A1 Jul. 15, 2010

(30) Foreign Application Priority Data

Jan. 9, 2009 (KR) ..... 10-2009-0001794

(51) Int. Cl.
*G03G 15/01* (2006.01)

(52) U.S. Cl. ..... 399/301; 399/39; 399/49

(58) Field of Classification Search ..... 399/38, 399/39, 46, 49, 297–301; 347/232; 358/1.12
See application file for complete search history.

(56) References Cited

U.S. PATENT DOCUMENTS 7,298,502 B2 * 11/2007 Kataoka et al. ..... 358/1.12
7,313,352 B2 * 12/2007 Shinohara et al. ..... 399/301
7,586,510 B2 * 9/2009 Maeda ..... 347/232

* cited by examiner

*Primary Examiner* — Hoan Tran
(74) *Attorney, Agent, or Firm* — Staas & Halsey LLP

(57) ABSTRACT

An image forming apparatus and an auto color registration method thereof, the auto color registration (ACR) method including: transferring test patterns respectively corresponding to a plurality of colors; detecting the transferred test patterns; cleaning the transferred test patterns; transferring patterns respectively corresponding to the plurality of colors by reducing a width of a pattern corresponding to a color, from among the plurality of colors, according to the detected test patterns; and performing ACR on the basis of the transferred pattern. Accordingly, at least one pattern width is reduced in consideration of deviation in a detected pattern width between a plurality of colors, and ACR is performed on the basis of the reduced pattern width, thereby decreasing an error and increasing reliability in the ACR.

25 Claims, 9 Drawing Sheets

| Color | K(dot) | Y(dot) | M(dot) | C(dot) |
|---|---|---|---|---|
| AVG | 52.7 | 47.5 | 47.8 | 47.4 |
| Max-Min | 5.5 | 6.8 | 6.5 | 3.0 |
| STDEV | 1.9 | 2.6 | 2.3 | 1.1 |

| Color | K(dot) | Y(dot) | M(dot) | C(dot) |
|---|---|---|---|---|
| AVG | 54.4 | 47.6 | 48.1 | 47.5 |
| Max-Min | 11.8 | 3.5 | 8.3 | 4.8 |
| STDEV | 4.7 | 1.0 | 2.6 | 1.5 |

IMAGE FORMING APPARATUS AND AUTO COLOR REGISTRATION METHOD THEREOF

CROSS-REFERENCE TO RELATED APPLICATION

This application claims priority from Korean Patent Application No. 10-2009-0001794, filed on Jan. 9, 2009 in the Korean Intellectual Property Office, the disclosure of which is incorporated herein by reference.

BACKGROUND OF THE INVENTION

1. Field of the Invention

Aspects of the present invention relate to an image forming apparatus and an auto color registration method thereof, and more particularly, to an image forming apparatus improved in auto color registration and an auto color registration method thereof.

2. Description of the Related Art

An image forming apparatus (such as a printer, a multi-function peripheral, a scanner, etc.) that forms a color image includes laser scanning units (LSU) provided to correspond to a plurality of colors, and an image forming unit provided with a plurality of photosensitive bodies or the like. The plurality of photosensitive bodies or the like are arranged along a transport path for a print medium transported by a transport unit, such as a transport belt.

In the image forming apparatus, to precisely print a color image on a print medium, positions where image transfers to the print medium start are to correspond with each other for the plurality of colors. Similarly, positions where image transfers to the print medium end are to correspond with each other for the plurality of colors. To this end, the image forming apparatus performs an auto color registration (ACR). The ACR is implemented to inspect whether the images corresponding to colors are correctly registered on the transport belt and printed, and to automatically correct if there is misregistration.

In detail, the image forming apparatus detects a plurality of patterns corresponding to a plurality of colors transferred onto the transport belt, and applies the ACR to a color shifted out of position. Specifically, the image forming apparatus measures an X offset and a Y offset according to a difference in a space between the plurality of detected patterns, and performs the ACR using the measured X and Y offsets so that the plurality of patterns corresponding to the plurality of colors are registered in position.

However, the ACR is based on the difference in a space between the patterns detected by an optical scanning unit. As a result, differences in light quantity according to colors can cause a detected value of the pattern width to differ from the real pattern width. For example, K (Black) absorbs more light than those of other colors, and thus a pattern width of K (Black) may be detected as larger than those of C (Cyan), M (Magenta) and Y (Yellow), even though their pattern widths are the same.

To reduce the difference in the detected pattern width, there has been conventionally proposed a method of increasing the light quantity for detection or transferring a large pattern width. However, the above method still has a problem due to the difference in the detected pattern width among colors, so that a correction effect is low and power and/or developers may be wastefully consumed. Thus, the difference in the detected pattern width between colors may cause an error in space difference between the patterns for the ACR, thereby lowering the reliability of the ACR.

SUMMARY OF THE INVENTION

Aspects of the present invention provide an image forming apparatus and an auto color registration (ACR) method thereof, in which at least one pattern width is reduced in consideration of deviation in a detected pattern width between a plurality of colors, and ACR is performed on the basis of the reduced pattern width, thereby decreasing an error and increasing reliability in the ACR. Aspects of the present invention also provide an image forming apparatus and an auto color registration (ACR) method thereof, in which resources used when increasing light quantity or enlarging a pattern width are prevented from being wastefully consumed.

According to an aspect of the present invention, there is provided an auto color registration (ACR) method of an image forming apparatus, the method including: transferring test patterns respectively corresponding to a plurality of colors; detecting the transferred test patterns; cleaning the transferred test patterns; transferring patterns respectively corresponding to the plurality of colors by reducing a width of a pattern corresponding to a color, from among the plurality of colors, according to the detected test patterns; and performing ACR on the basis of the transferred pattern, wherein the width is reduced as compared to a width of the transferred test pattern corresponding to the color.

The detecting of the transferred test pattern may include measuring a width of the transferred test pattern, and the transferring of the patterns respectively corresponding to the plurality of colors may include transferring the patterns respectively corresponding to the plurality of colors by reducing the width of the pattern corresponding to the color on the basis of the measured width of the test pattern.

The method may further include determining a correction pattern width obtained by reducing a width of the pattern corresponding to the color, and the transferring of the patterns respectively corresponding to the plurality of colors may include transferring the patterns on the basis of the determined correction pattern width.

The determining of the correction pattern width may include comparing a detected value of the width of the test pattern with a predetermined reference value, and determining the correction pattern width such that the detected value is equal to the predetermined reference value.

The test patterns may be transferred a plurality of times, and the determining of the correction pattern width may include determining the correction pattern width such that an average of the detected width values of the test patterns transferred a plurality of times is equal to the predetermined reference value.

The determining the correction pattern width may include excluding maximum and minimum values from the detected width values of the test patterns and determining the correction pattern width such that an average of the other detected width values of the test patterns is equal to the reference value.

The determining of the correction pattern width may include determining the correction pattern width such that the patterns measured according to the plurality of colors have the same detected width value.

The plurality of colors may include Cyan (C), Magenta (M), Yellow (Y) and Black (K).

The plurality of colors may include at least four colors.

According to another aspect of the present invention, there is provided an image forming apparatus including: a transport unit including a transport belt; an image forming unit to transfer test patterns respectively corresponding to a plurality of colors onto the transport belt; a detecting unit to detect the transferred test patterns; and a controller to control the image forming unit to clean the transferred test patterns, to transfer patterns respectively corresponding to the plurality of colors by reducing a width of a pattern corresponding to a color, from among the plurality of colors, and to perform auto color registration (ACR) on the basis of the transferred pattern.

The detecting unit may measure a width of the test pattern corresponding to the color, and the controller may control the image forming unit to transfer the patterns respectively corresponding to the plurality of colors by reducing a width of the pattern corresponding to the color on the basis of the measured width of the test pattern.

The controller may determine a correction pattern width obtained by reducing a width of the pattern corresponding to the color, and transfer the pattern on the basis of the determined correction pattern width.

The controller may compare a detected value of the measured width of the test pattern with a predetermined reference value, and determine a correction pattern width such that the detected value is equal to the predetermined reference value.

The test patterns may be transferred a plurality of times, and the controller may determine the correction pattern width such that an average of the detected width values of the test patterns transferred a plurality of times is equal to the predetermined reference value.

The controller may exclude maximum and minimum values from the detected width values of the test patterns and determine the correction pattern width such that an average of the detected width values of the test patterns, excluding the maximum and minimum values, is equal to the predetermined reference value.

The controller may determine the correction pattern width such that the patterns measured according to the plurality of colors have the same detected width value.

The plurality of colors may include Cyan (C), Magenta (M), Yellow (Y) and Black (K).

The plurality of colors may include at least four colors.

According to yet another aspect of the present invention, there is provided an auto color registration (ACR) method of an image forming apparatus, the method including: transferring, by the image forming apparatus, a test pattern corresponding to a color; detecting a width of the transferred test pattern; determining a difference between the detected width of the test pattern and a predetermined reference value; determining a correction pattern width for the color according to the determined difference, the correction pattern width being used by the image forming apparatus to transfer a pattern corresponding to the color in an ACR such that a detected width of the pattern is equal to the predetermined reference value.

According to still another aspect of the present invention, there is provided an auto color registration (ACR) method of an image forming apparatus, the method including: transferring, by the image forming apparatus, a pattern corresponding to a color according to a correction pattern width; and performing ACR on the basis of the transferred pattern, wherein the correction pattern width is predetermined according to a light absorbability of the color such that a detected value of a width of the transferred pattern is equal to a predetermined reference value.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
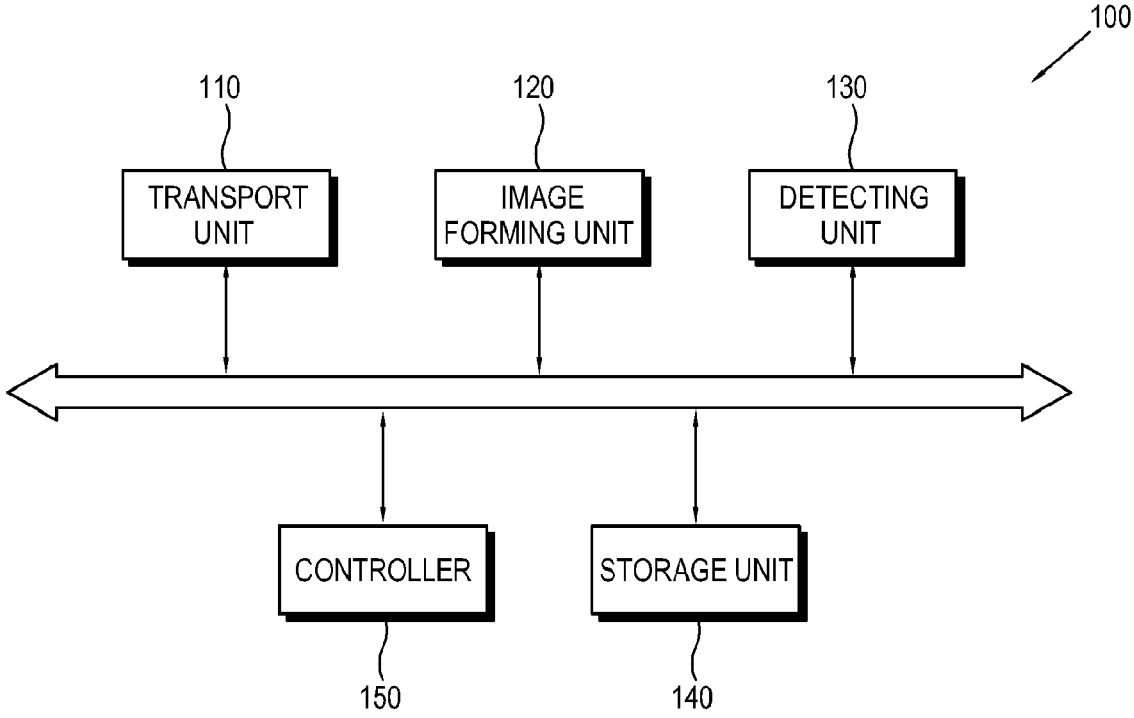
FIG. 1 is a block diagram showing a configuration of an image forming apparatus according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

FIG. 1 is a block diagram showing a configuration of an image forming apparatus 100 according to an embodiment of the present invention. Here, the image forming apparatus 100 may be a printer, a copying machine, a facsimile device, a scanner, and a multi-function peripheral having two or more operations. Referring to FIG. 1, the image forming apparatus 100 includes a transport unit 110, an image forming unit 120, a detecting unit 130, a storage unit 140, and a controller 150. While not required, the controller 150 can be one or more processors or processing elements on one or more chips or integrated circuits.

Figure 2:
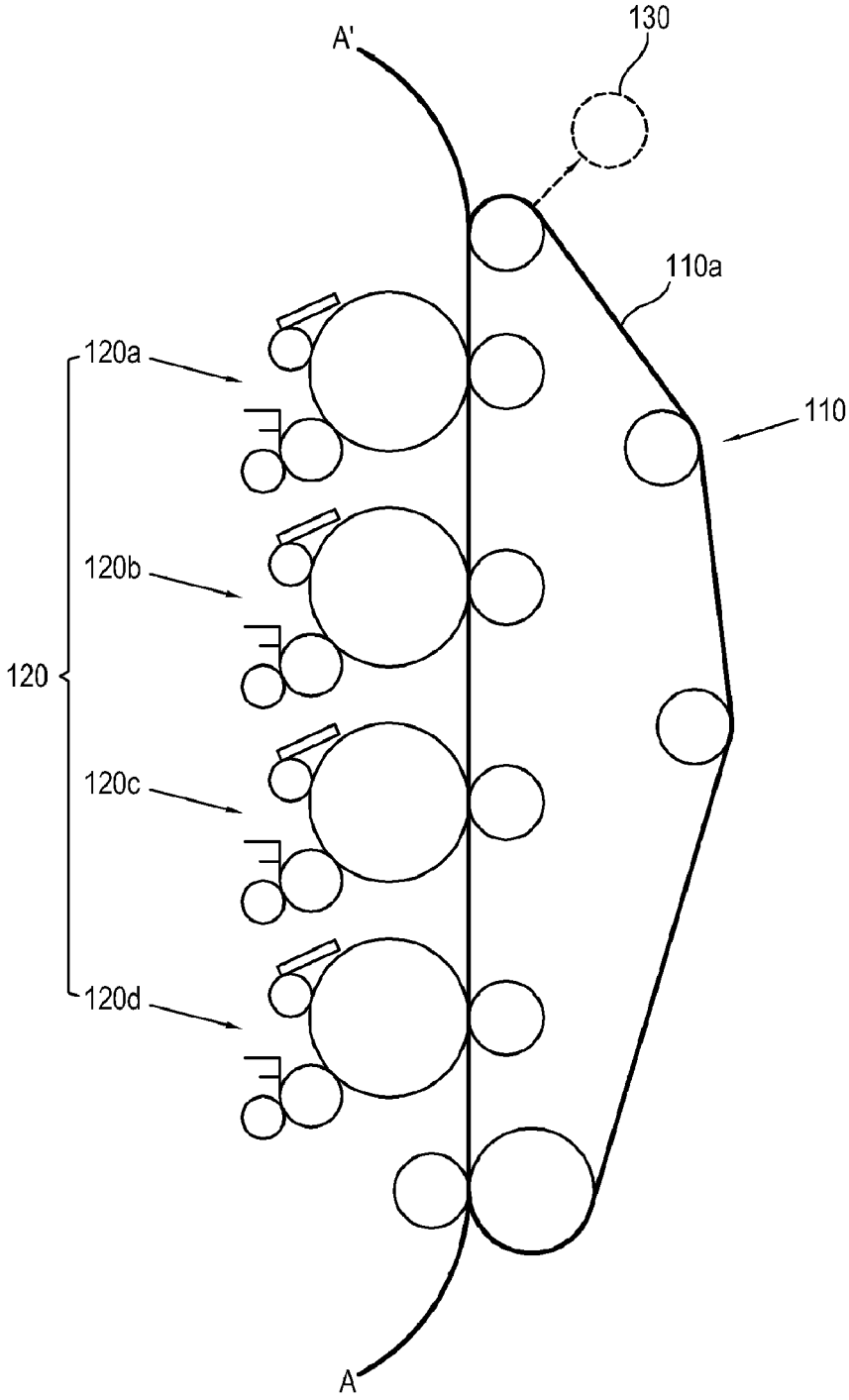
FIG. 2 is a sectional view of a transport unit according to an embodiment of the present invention.

Under control of the controller 150, the transport unit 110 transports an image developed by the image forming unit 120 or a print medium on which the image is formed. FIG. 2 is a sectional view of a transport unit 110 according to an embodiment of the present invention. Referring to FIG. 2, the transport unit 110 includes a transport belt 110*a* and transports an image or a print medium (not shown) with the image formed thereon by moving the transport belt 110*a*. Specifically, the print medium comes from a direction of A and exits in a direction of A' through the transport belt 110*a* (hereinafter, referred to as a "transport path for the print medium"). That is, the transport belt 110*a* moves corresponding to the transport path for the print medium.

The image forming unit 120 forms an image based on print data onto at least one recording medium (such as paper, a transparency, etc.) in response to a print command. Here, the print command may include a print command to print a copy after scanning a document, a print command to print received fax data, and a print command to print data received from an external host apparatus 200 (such as a server, a personal computer, a workstation, a mobile device, etc.) or stored in an interior (such as a hard disk drive (HDD)) or exterior (such as a universal serial bus (USB) memory) of the image forming apparatus 100. The image forming unit 120 performs exposure, development, and transfer, thereby forming an image by transferring a developer (e.g., a toner) onto the recording medium according to the print data.

Referring to FIG. 2, the image forming unit 120 includes a plurality of exposure units 120*a* to 120*d* corresponding to a plurality of colors. In the shown embodiment, the image forming unit 120 includes four exposure units 120*a* to 120*d* corresponding to C (Cyan), M (Magenta), Y (Yellow) and K (Black), though it is understood that aspects of the present invention are not limited thereto. That is, according to other aspects, the image forming unit 120 may include more than or less than four exposure units 120*a* to 120*d*. The plurality of exposure units 120*a* to 120*d* scans light to form a plurality of patterns (including a test pattern) for auto color registration (ACR). Also, while the plurality of patterns correspond to C, M, Y and K in the shown embodiment, it is understood that aspects of the present invention are not limited thereto. Alternatively, the plurality of patterns may correspond to other colors according to colors supported by the image forming unit 120. For example, the image forming unit 120 may support six colors, eight colors, or nine colors. If the image forming unit 120 supports six colors, the plurality of (i.e., six) patterns may be formed corresponding to Lc (Light Cyan) and Lm (Light Magenta) in addition to C, M, Y and K. Likewise, if the image forming apparatus 120 supports eight colors, the plurality of (i.e., eight) patterns may be formed corresponding to Gr (Green) and Or (Orange) in addition to C, M, Y, K, Lc and Lm. Further, if the image forming apparatus 120 supports nine colors, the plurality of (i.e., nine) patterns may be formed corresponding to B (Photo Blue), Lg (Light Gray) and G (Dark Gray) in addition to C, M, Y, K, Lc and Lm.

The image forming unit 120 transfers a plurality of test patterns to determine a correction pattern width for color registration under the control of the controller 150. Specifically, the image forming apparatus 100 determines a correction pattern width obtained by reducing the pattern width corresponding to at least one of the plurality of colors in consideration of a deviation in a width between the transferred test patterns, and performs auto color registration (ACR) on the basis of the determined correction pattern width.

Figure 3A:
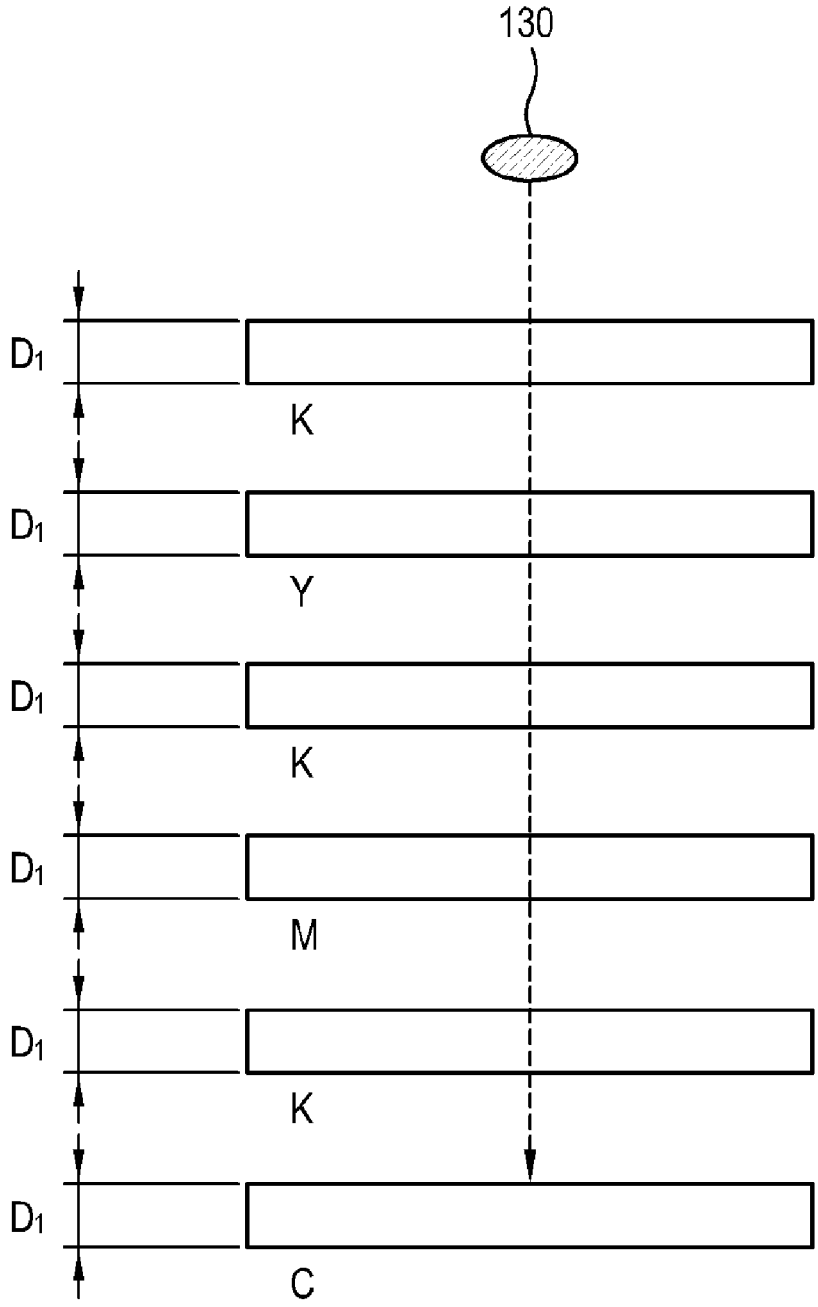
FIGS. 3A and 3B illustrate test patterns transferred according to an embodiment of the present invention.
Figure 3B:
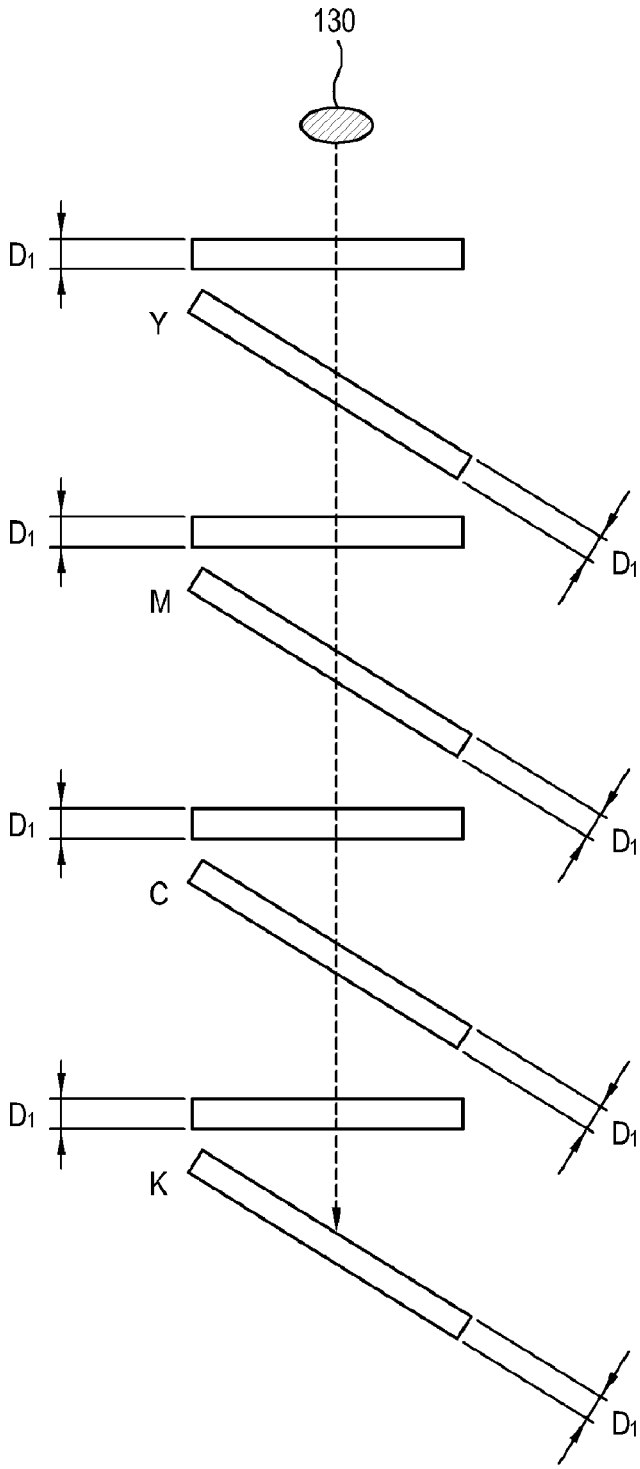

In the shown embodiment, the patterns (including the test patterns) are formed at a predetermined position (not shown) on a surface of the transport belt 110*a* on the basis of test data. The patterns may be formed corresponding to the plurality of exposure units 120*a* to 120*d*, respectively. The patterns may be achieved by a predetermined symbol or character. For example, the patterns may be achieved by a bar pattern, as shown in FIG. 3A, or combination of a bar pattern and a slant pattern that are registered differently in a spaced distance therebetween at opposite ends, as shown in FIG. 3B.

The detecting unit 130 is provided on a moving path of the transport belt 110*a*, as shown in FIG. 2, and detects light reflected from the patterns. Here, the detecting unit 130 may be an optical sensor that includes a light emitting unit and a light receiving unit. Specifically, the detecting unit 130 detects the light reflected from the test patterns transferred onto the transport belt 110*a*, and measures a width of the test pattern. The measured results from the detecting unit 130 are transmitted to the controller 150. The controller 150 determines the correction pattern width for performing the ACR in consideration of the deviation in the width between the test patterns measured corresponding to the colors, and performs the ACR on the basis of the determined correction pattern width.

The storage unit 140 stores print data corresponding to a printing job, and test data corresponding to the test patterns. The image forming unit 120 loads the print data and the test data from the storage unit 140, and performs the printing job and the ACR on the basis of the print data and the test data, respectively. The storage unit 140 may further store data about the correction pattern width determined by measuring the width of the test pattern. The controller 140 controls the image forming unit 120 to perform the ACR on the basis of the stored data about the correction pattern width. Moreover, the storage unit 140 may further store data about results from the ACR performed by the image forming apparatus 100. It is understood that the storage unit 140 may include an internal storage medium such as a hard disk drive (HDD), or an external or portable storage medium such as a USB memory or a memory card (memory stick, compact flash (CF) card, a multi-media card (MMC), or the like).

The controller 150 performs general controls for the image forming apparatus 100. In the shown embodiment, the controller 150 may be achieved by combining hardware such as a central processing unit (CPU) with software or firmware. The controller 150 controls the image forming unit 120 to form an image on the recording medium on the basis of the print data, and to transfer the test pattern and the pattern having a reduced width to the transport belt 110*a* on the basis of the test data.

Specifically, the controller 150 controls the image forming unit 120 to transfer the test pattern to the transport belt 110*a*, and controls the detecting unit 130 to measure the test pattern width by detecting the transferred test pattern. Here, the controller 150 determines the correction pattern width by reducing the pattern width corresponding to at least one of the plurality of colors on the basis of the measured test pattern width.

If a preset condition to start the ACR is satisfied by replacement of a developer, opening and/or closing of a cover, printing a specific number of sheets of recording media, etc., the controller controls the image forming unit 120 to form the pattern having a pattern width reduced on the basis of the measured test pattern width on the transport belt 110*a*, thereby performing the ACR.

FIGS. 3A and 3B illustrate test patterns transferred according to an embodiment of the present invention. Referring to FIG. 3A, the controller 150 controls the image forming unit 120 to transfer the plurality of patterns (e.g., bar patterns) respectively corresponding to the plurality of colors (such as C, M, Y and K) onto the surface of the transport belt 110*a* at least once. For example, the plurality of test patterns may be transferred six to eight times according to the colors, respectively. Moreover, the controller 150 controls the image forming unit 120 to transfer the test patterns having the same width D1 corresponding to the plurality of colors. Here, the width D1 of the test pattern will be used as a reference value (to be described later).

Likewise, referring to FIG. 3B, the controller 150 controls the image forming unit 120 to transfer the plurality of test patterns (e.g., slant patterns) respectively corresponding to the plurality of colors onto the surface of the transport belt 110*a* at least once. Here, the plurality of test patterns may be transferred six to eight times according to the colors, respectively. Furthermore, the controller 150 controls the image forming unit 150 to transfer the test patterns having the same width D1 (i.e., the reference value) corresponding to the plurality of colors As shown in FIGS. 3A and 3B, the controller 150 controls the detecting unit 130 to detect the light reflected from the plurality of test patterns transferred on the transport belt 110*a*, and measures the widths of the test patterns. Here, a real detected width value of the test pattern varies depending on the light absorbability of the plural colors.

Figure 4A:
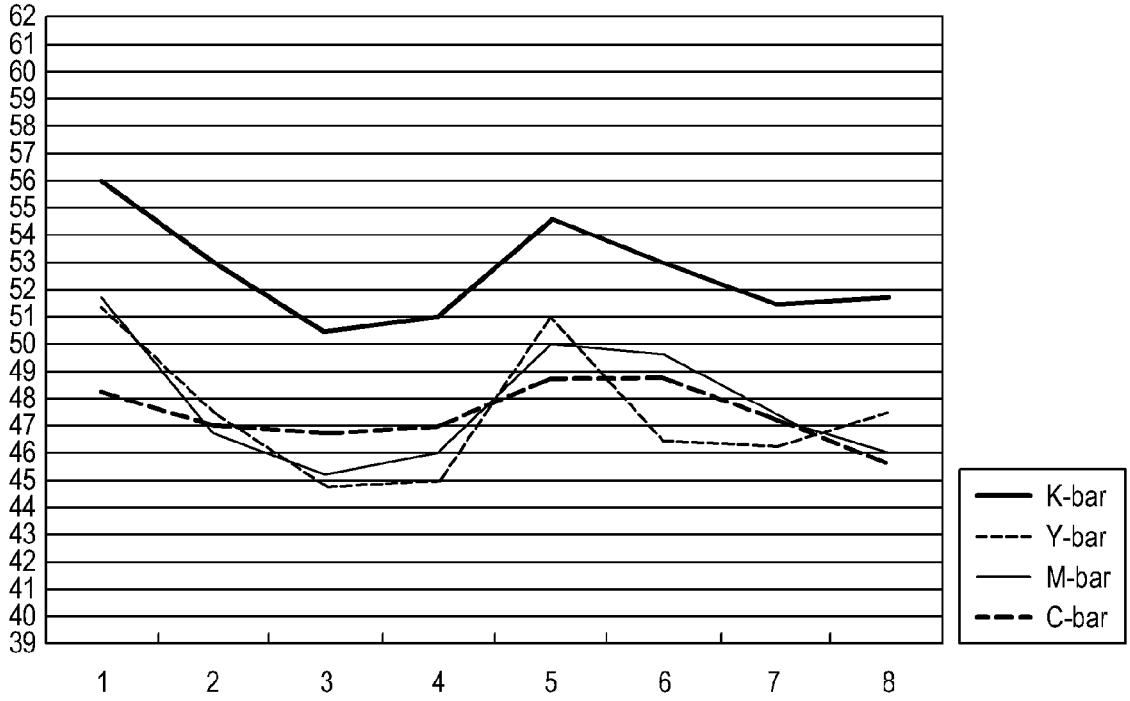
FIGS. 4A and 4B show detected width values of the test pattern according to an embodiment of the present invention.
Figure 4B:
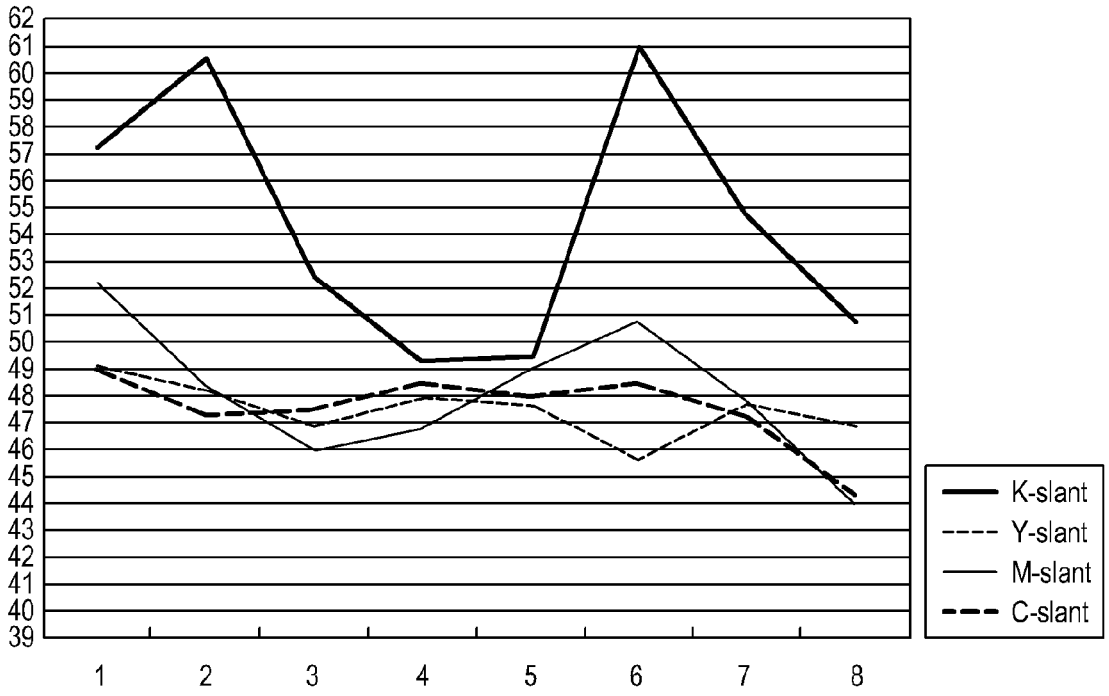

FIGS. 4A and 4B show detected width values of the test pattern according to an embodiment of the present invention. Referring to FIGS. 4A and 4B, even though the image forming unit 120 transfers the test patterns having the same pattern width D1, the widths of the test patterns detected by the detecting unit may differ from one another.

FIG. 4A shows detected width values of the test patterns shown in FIG. 3A (i.e., bar patterns). Referring to FIG. 4A, the detected width value corresponding to K (Black) averages 52.7 dots, which is more than the average detected width values of other colors. That is, the detected value of K (Black) is the largest since it has higher absorbability than other colors. In the case of M(Magenta) and Y(Yellow), there is a deviation Max-Min of 6 or more dots between the maximum detected value and the minimum detected value according to colors, and a standard deviation STDEV according to colors is 1.1 to 2.6 dots.

FIG. 4B shows detected width values of the test patterns shown in FIG. 3B (i.e., slant patterns). Referring to FIG. 4B, the detected width value corresponding to K (Black) averages 54.4 dots, which is more than the detected width values of other colors and the detected width values of the bar pattern. Also, K (Black) has a deviation of 11.8 dots between the maximum detected value and the minimum detected value, and M (Magenta) has a deviation of 8.3 dots.

The controller 150 determines the correction pattern width having a reduced pattern width corresponding to at least one among the plurality of colors on the basis of the width of the test pattern measured as shown in FIGS. 4A and 4B. Here, the controller 150 may compare a detected width value of the test pattern with a predetermined reference value D1, and determine a correction pattern width so that the detected value can be equal to the reference value D1. In more detail, if the test patterns are transferred at least one time, the controller 150 determines the correction pattern width so that the average detected width value of the plurality test patterns transferred according to colors can be equal to the reference value D1.

For example, if the bar-type test patterns and the slant-type test patterns are each transferred eight times, the controller 150 determines the correction pattern width of the bar patterns with respect to K (Black) so that the average detected value of eight bar-type test patterns with regard to K (Black) is equal to the reference value D1. Likewise, the controller 150 determines the correction pattern width so that the averaged detected value of eight bar-type test patterns is equal to the reference value D1 with regard to C (Cyan), M (Magenta) and Y (Yellow). Also, the controller 150 determines the correction pattern width of the slant patterns so that the average detected value of eight slant-type test patterns with respect to each color is equal to the reference value D1.

While not restricted thereto, in the present embodiment, the correction pattern widths of the bar and slant patterns determined as described above are tabulated as follows:

TABLE 1

Bar pattern width before and after correction

| | Width of test pattern | | Width of corrected pattern | |
|---|---|---|---|---|
| | Transferred value | Detected value | Transferred value | Detected value |
| K | 2 mm (47 dots) | 2.2 mm (54 dots) | 1.8 mm (42 dots) | 2 mm (47 dots) |
| Y | 2 mm (47 dots) | 2.01 mm (48 dots) | 1.9 mm (45 dots) | 2 mm (47 dots) |
| C | 2 mm (47 dots) | 2.01 mm (48 dots) | 1.9 mm (45 dots) | 2 mm (47 dots) |
| M | 2 mm (47 dots) | 2.01 mm (48 dots) | 1.9 mm (45 dots) | 2 mm (47 dots) |

TABLE 2

Slant pattern width before and after correction

| | Width of test pattern | | Width of corrected pattern | |
|---|---|---|---|---|
| | Transferred value | Detected value | Transferred value | Detected value |
| K | 2 mm (47 dots) | 2.2 mm (54 dots) | 1.8 mm (42 dots) | 2 mm (47 dots) |
| Y | 2 mm (47 dots) | 2.01 mm (48 dots) | 1.9 mm (45 dots) | 2 mm (47 dots) |
| C | 2 mm (47 dots) | 2.01 mm (48 dots) | 1.9 mm (45 dots) | 2 mm (47 dots) |
| M | 2 mm (47 dots) | 2.01 mm (48 dots) | 1.9 mm (45 dots) | 2 mm (47 dots) |

Referring to the correction pattern widths shown in tables 1 and 2, the pattern widths transferred from the image forming unit 120 differ from one another, but the detected values in the detecting unit 130 have the same reference value D1 (i.e., 2 mm (47 dots)). That is, the controller 150 determines the correction pattern width so that the detected width values of the test patterns measured according to the plurality of colors are equal to one another.

When the condition to start the ACR is satisfied, the controller 150 controls the image forming unit 120 to transfer the patterns having the correction pattern width determined as shown in the tables 1 and 2 onto the transport belt 110*a*, thereby performing the ACR.

In the present embodiment, the transferred values of the correction pattern widths are less than the corresponding transferred values of the test pattern widths. However, it is understood that aspects of the present invention are not limited thereto. For example, in the case of a color having low light absorbability, the transferred value of the correction pattern width may be greater than the corresponding transferred value of the test pattern width.

Figure 5A:
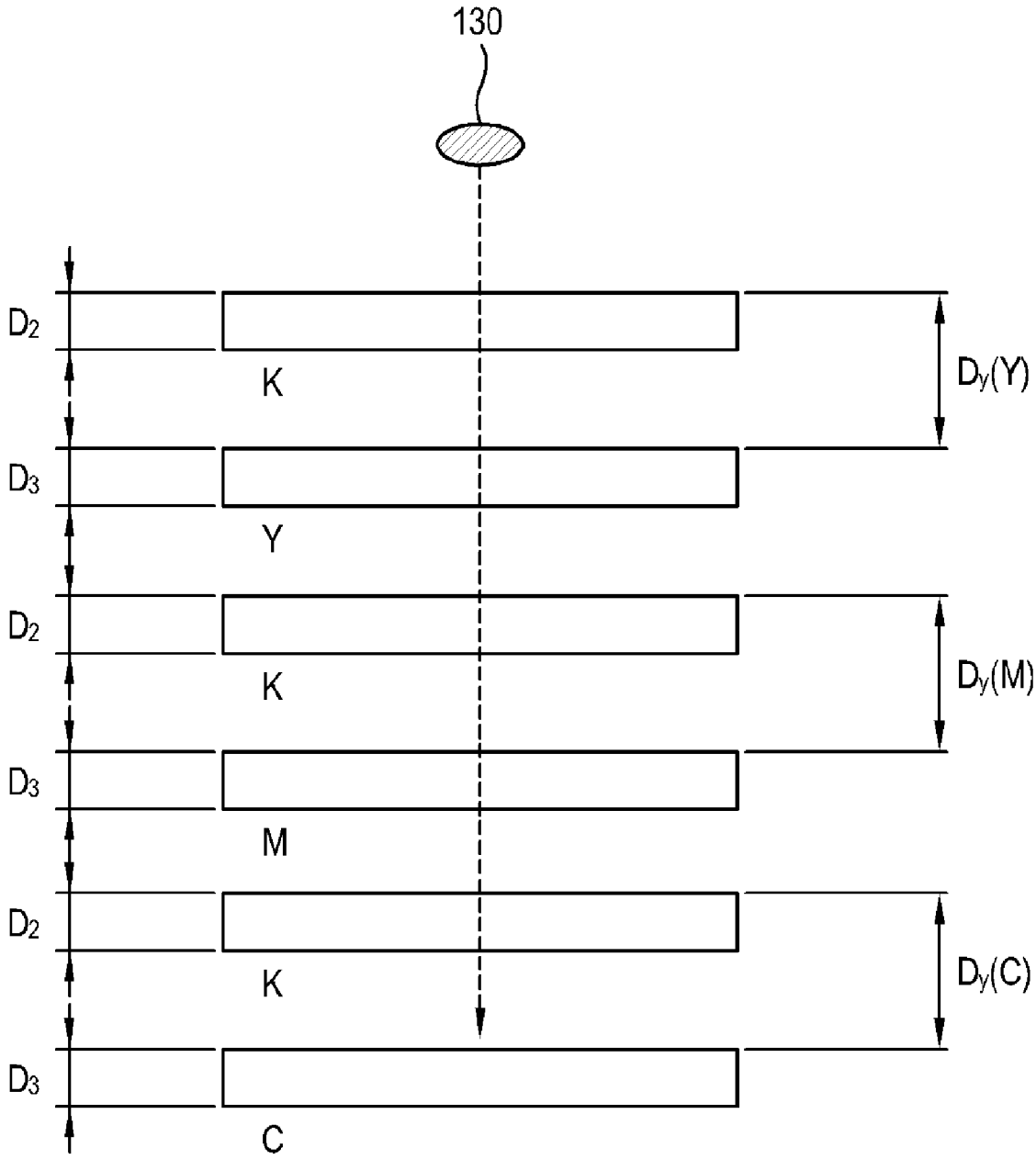
FIGS. 5A and 5B illustrate auto color registration (ACR) patterns with a correction pattern width according to an embodiment of the present invention.
Figure 5B:
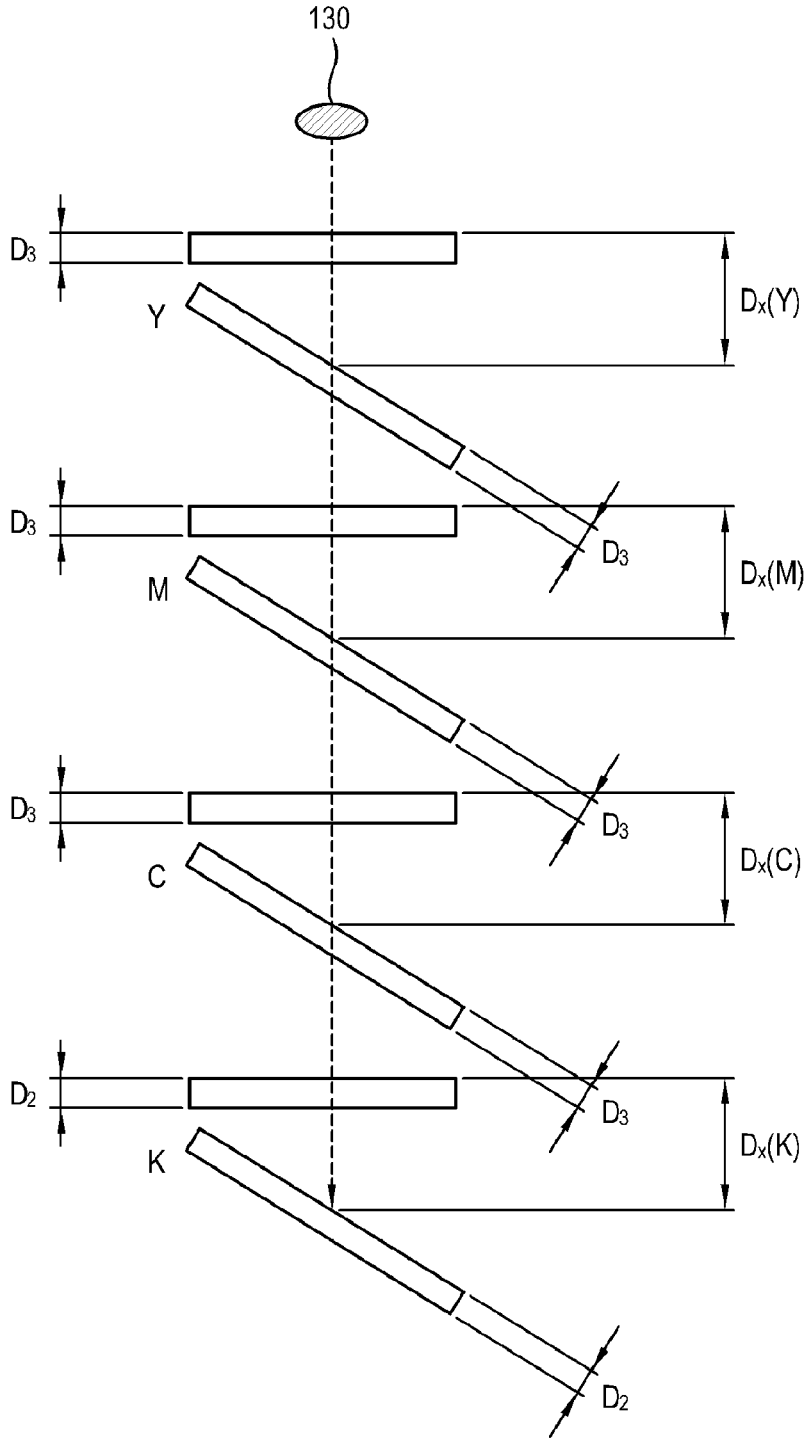

FIGS. 5A and 5B illustrate auto color registration (ACR) patterns with a correction pattern width according to an embodiment of the present invention. Referring to FIGS. 5A and 5B, the controller 150 controls the image forming unit 120 to transfer the patterns having the reduced pattern widths D2 and D3 according to colors. In the shown embodiment, the image forming unit 120 transfers the pattern having the correction pattern width D2 of 1.8 mm (42 dots) with respect to K (Black), and the patterns having the correction pattern width D3 of 1.9 mm (45 dots) with respect to C (Cyan), M (Magenta), and Y (Yellow).

The controller 150 controls the detecting unit 130 to detect the patterns having the plurality of correction pattern widths D2 and D3 transferred corresponding to the plurality of colors, and applies the ACR to a color shifted out of position. Specifically, as shown in FIG. 5A, the controller 150 measures a Y offset using space differences Dy(Y), Dy(M), and Dy(C) between the plurality of patterns detected with respect to a reference color (e.g., K), and performs correction with regard to the measured Y offset. Also, as shown in FIG. 5B, the controller 150 measures an X offset using space difference sDx(Y), Dx(M), Dx(C), and Dx(K) between the bar and slant patterns according to the plurality of colors, and performs correction with regard to the X offset. Accordingly, the controller 150 corrects the X and Y offsets and, thus, performs the ACR, so that the patterns according to the plurality of colors can be registered in position.

According to aspects of the present invention, the image forming apparatus 100 performs the ACR on the basis of the pattern width corrected in consideration of differences in absorbed light quantity between respective colors. Thus, the image forming apparatus 100 not only decreases an error due to the differences in the absorbed light quantity between respective colors when performing the ACR, but also increases the reliability of the ACR. Also, resources used when increasing light quantity or enlarging a pattern width to reduce an error in measuring the pattern width are prevented from wastefully being consumed. In the shown embodiment, the image forming apparatus 100 may maintain the pattern width within 42 to 45 dots, though other embodiments are not limited thereto.

While in the above-described embodiment, eight test patterns according to colors are transferred to determine the correction pattern widths based on the average detected values, it is understood that aspects of the present invention are not limited thereto. For example, the correction pattern width may be determined such that an average of six pattern widths excluding the maximum and minimum values among eight test patterns according to colors can be equal to the reference value. Furthermore, in some aspects, a detected value that differs from the reference value by a predetermined value or more may be ignored, and the correction pattern width is determined such that an average of the other detected values can be equal to the reference value.

As described above, according to aspects of the present invention, the image forming apparatus 100 determines the correction pattern width by transferring the test patterns once, stores data about the determined correction pattern widths in the storage unit 140, and performs the ACR by transferring the patterns having the correction pattern widths stored in the storage unit 140 when the condition to start the ACR is satisfied. Here, a previously transferred test pattern is cleaned in the transport belt 110*a* before performing the ACR, thereby having no effect on the ACR. In some cases, the image forming apparatus 100 may measure the transferred pattern width while performing the ACR when the condition to start the ACR is satisfied, thereby simultaneously correcting the pattern width and the performing the ACR.

Also, though the above-described embodiment is directed to transferring the test pattern and the ACR pattern onto the transport belt 110*a*, it is understood that other embodiments are not limited thereto. Alternatively, aspects of the present invention may be applied to an image forming apparatus 100 in which the test pattern or the ACR pattern is transferred to a recording medium (such as paper, a transparency, etc.).

Figure 6:
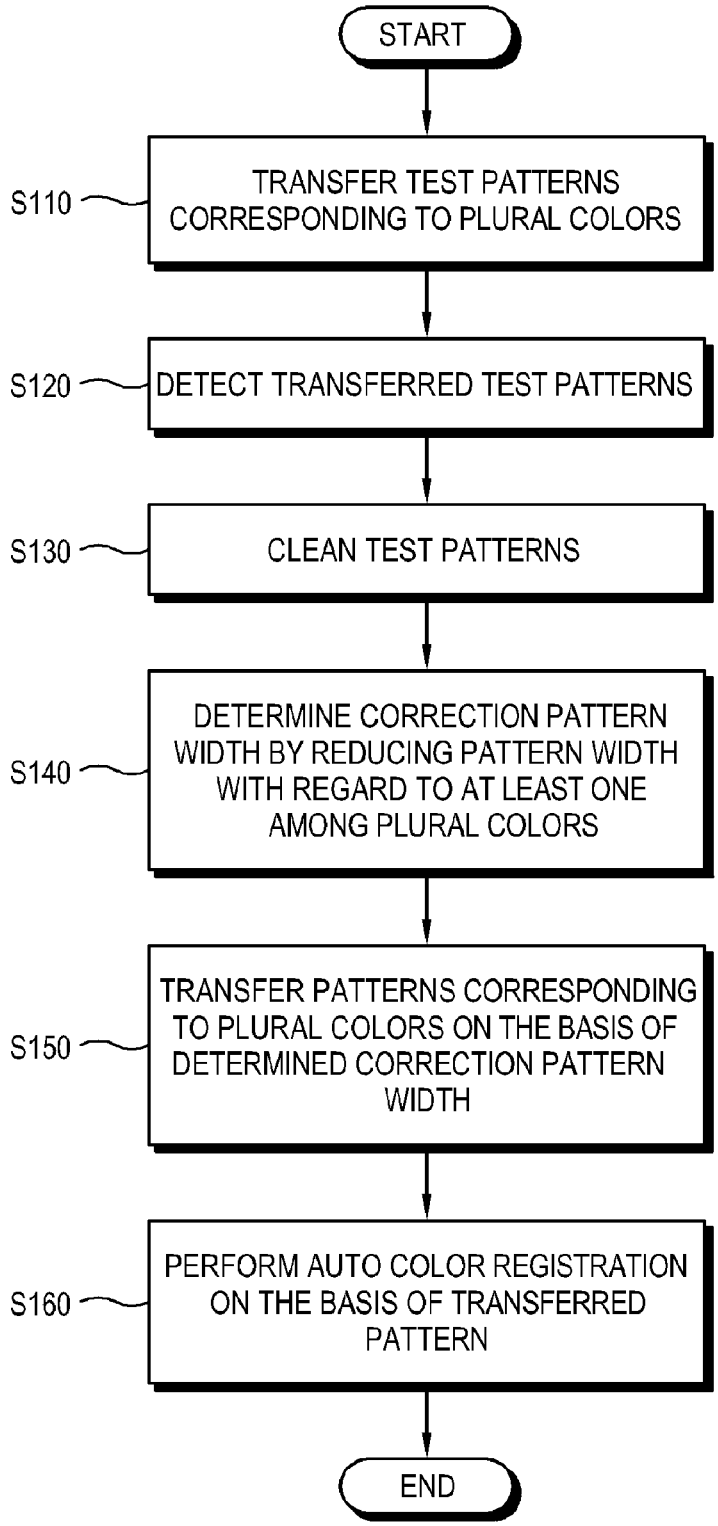
FIG. 6 is a flowchart of an ACR method of the image forming apparatus according to an embodiment of the present invention.

FIG. 6 is a flowchart of an ACR method of the image forming apparatus 100 according to an embodiment of the present invention. Referring to FIG. 6, the controller 150 controls the image forming unit 120 to transfer the developer onto the surface of the transport belt 110*a* and form the plurality of test patterns respectively corresponding to the plurality of colors at least one time in operation S110. For example, the plurality of test patterns may correspond to at least four colors (such as C, M, Y, and K) supported in the image forming unit 120.

The detecting unit 130 detects the plurality of transferred test patterns in operation S120. Here, the detecting unit 130 detects the light reflected from the plurality of transferred test patterns, and measures the widths of the test patterns.

The controller 150 cleans the transferred test patterns in operation S130. The controller 150 determines the correction pattern widths D2, D3 by reducing the pattern width of at least one among the plurality of colors on the basis of the measured test pattern widths in operation S140. Here, the controller 150 may determine the correction pattern width so that an average of the detected width values of the transferred test patterns for a corresponding color is equal to the reference value D1, or determines the correction pattern width so that an average of detected values excluding maximum and minimum values among the detected width values of the test patterns for a corresponding color is equal to the reference value D1. Also, a detected value that differs from the reference value by a predetermined value or more may be ignored, and the correction pattern width is determined such that an average of the other detected values is equal to the reference value. Thus, the detected width values of the test patterns measured according to the plurality of colors are equal to one another. While the cleaning of the test patterns (operation S130) is described as occurring before the determining of the correction pattern widths (operation S140), it is understood that the cleaning of the test patterns (operation S130) can occur simultaneously or after the determining of the correction pattern widths (operations 140). Moreover, the data about the correction pattern width D2, D3 determined in the operation S140 may be stored in the storage unit 140.

The controller 150 controls the image forming unit 120 to transfer the patterns (i.e., the ACR patterns) respectively corresponding to the plurality of colors on the basis of the determined correction pattern width D2, D3 if the condition to start the ACR is satisfied in operation S150. The controller 150 performs the ACR on the basis of the transferred patterns in operation S160.

As described above, aspects of the present invention provide an image forming apparatus and an auto color registration (ACR) method thereof, in which at least one pattern width is reduced in consideration of deviation in a detected pattern width between a plurality of colors, and ACR is performed on the basis of the reduced pattern width, thereby decreasing an error and increasing reliability in the ACR. Accordingly, resources used when increasing light quantity or enlarging a pattern width are prevented from wastefully consumed.

While not restricted thereto, aspects of the present invention can also be embodied as computer-readable code on a computer-readable recording medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network-coupled computer systems so that the computer-readable code is stored and executed in a distributed fashion. Aspects of the present invention may also be realized as a data signal embodied in a carrier wave and comprising a program readable by a computer and transmittable over the Internet.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An auto color registration (ACR) method of an image forming apparatus, the method comprising:

transferring, by the image forming apparatus, test patterns respectively corresponding to a plurality of colors;

detecting the transferred test patterns;

cleaning the transferred test patterns;

transferring, by the image forming apparatus, patterns respectively corresponding to the plurality of colors by changing a width of a pattern corresponding to a color, from among the plurality of colors, according to the detected test patterns; and performing ACR on the basis of the transferred patterns, wherein the width is changed as compared to a width of the transferred test pattern corresponding to the color.

2. The method as claimed in claim 1, wherein:

the detecting of the transferred test patterns comprises measuring the width of the transferred test pattern corresponding to the color; and the transferring of the patterns respectively corresponding to the plurality of colors comprises reducing the width of the pattern corresponding to the color according to the measured width of the transferred test pattern.

3. The method as claimed in claim 1, further comprising:

determining a correction pattern width for the color by reducing the width of the pattern corresponding to the color, wherein the transferring of the patterns respectively corresponding to the plurality of colors comprises transferring the pattern corresponding to the color on the basis of the determined correction pattern width.

4. The method as claimed in claim 3, wherein the determining of the correction pattern width comprises:

comparing a detected value of the width of the test pattern corresponding to the color with a predetermined reference value; and determining the correction pattern width according to the comparing of the detected value with the predetermined reference value such that a detected width of transferred pattern is equal to the predetermined reference value.

5. The method as claimed in claim 4, wherein:

the comparing of the detected value with the predetermined reference value comprises determining a difference between the detected value and the predetermined reference value; and the determining of the correction pattern width comprises determining the correction pattern width to be less than or greater than the predetermined reference value by the determined difference.

6. The method as claimed in claim 3, wherein:

the transferring of the test patterns respectively corresponding to the plurality of colors comprises transferring the test patterns a plurality of times; and the determining of the correction pattern width comprises:

comparing an average of detected values of widths of the test patterns corresponding to the color with a predetermined reference value, and determining the correction pattern width according to the comparing of the average of the detected values with the predetermined reference value such that a detected width of the transferred pattern is equal to the predetermined reference value.

7. The method as claimed in claim 6, wherein:

the comparing of the average of the detected values with the predetermined reference value comprises comparing the average of the detected values excluding maximum and minimum values from among the detected width values of the test patterns corresponding to the color; and the determining of the correction pattern width comprises determining the correction pattern width according to the comparing of the average of the detected values, excluding the maximum and minimum values, with the predetermined reference value such that the detected width of the transferred pattern is equal to the predetermined reference value.

8. The method as claimed in claim 3, wherein the determining of the correction pattern width comprises determining the correction pattern width such that detected widths of the transferred patterns are equal.

9. The method as claimed in claim 1, wherein the plurality of colors includes Cyan (C), Magenta (M), Yellow (Y) and Black (K).

10. The method as claimed in claim 1, wherein the plurality of colors includes at least four colors.

11. An image forming apparatus comprising:

a transport unit comprising a transport belt;

an image forming unit to transfer test patterns respectively corresponding to a plurality of colors onto the transport belt;

a detecting unit to detect the transferred test patterns; and a controller to control the image forming unit to transfer patterns respectively corresponding to the plurality of colors by changing a width of a pattern corresponding to a color, from among the plurality of colors, according to the detected test patterns and to perform auto color registration (ACR) on the basis of the transferred patterns, wherein the width is changed as compared to a width of the transferred test pattern corresponding to the color.

12. The image forming apparatus as claimed in claim 11, wherein:

the detecting unit measures the width of the transferred test pattern corresponding to the color; and the controller controls the image forming unit to transfer the patterns respectively corresponding to the plurality of colors by reducing the width of the pattern corresponding to the color according to the measured width of the transferred test pattern.

13. The image forming apparatus as claimed in claim 11, wherein the controller determines a correction pattern width for the color by reducing the width of the pattern corresponding to the color, and transfers the pattern corresponding to the color on the basis of the determined correction pattern width.

14. The image forming apparatus as claimed in claim 13, wherein the controller compares a detected value of the width of the test pattern corresponding to the color with a predetermined reference value, and determines the correction pattern width according to the comparing of the detected value with the predetermined reference value such that a detected width of the transferred pattern is equal to the predetermined reference value.

15. The image forming apparatus as claimed in claim 14, wherein the controller compares the detected value with the predetermined reference value to determine a difference between the detected value and the predetermined reference value, and determines the correction pattern width to be greater than or less than the predetermined reference value by the determined difference.

16. The image forming apparatus as claimed in claim 13, wherein:

the image forming unit transfers the test patterns a plurality of times; and the controller compares an average of detected values of widths of the test patterns corresponding to the color with a predetermined reference value, and determines the correction pattern width according to the comparing of the average of the detected values with the predetermined reference value such that a detected width of the transferred pattern is equal to the predetermined reference value.

17. The image forming apparatus as claimed in claim 16, wherein the controller compares the average of the detected values excludes maximum and minimum values from among the detected width values of the test patterns corresponding to the color, and determines the correction pattern width according to the comparing of the average of the detected values, excluding the maximum and minimum values, with the predetermined reference value such that the detected width of the transferred pattern is equal to the predetermined reference value.

18. The image forming apparatus as claimed in claim 13, wherein the controller determines the correction pattern width such that detected widths of the transferred patterns are equal.

19. The image forming apparatus as claimed in claim 11, wherein the plurality of colors includes Cyan (C), Magenta (M), Yellow (Y), and Black (K).

20. The image forming apparatus as claimed in claim 11, wherein the plurality of colors includes at least four colors.

21. An auto color registration (ACR) method of an image forming apparatus, the method comprising:

transferring, by the image forming apparatus, a test pattern corresponding to a color;

detecting a width of the transferred test pattern;

determining a difference between the detected width of the test pattern and a predetermined reference value;

determining a correction pattern width for the color according to the determined difference, the correction pattern width being used by the image forming apparatus to transfer a pattern corresponding to the color in an ACR such that a detected width of the pattern is equal to the predetermined reference value.

22. The method as claimed in claim 21, further comprising:

transferring, by the image forming apparatus, the pattern corresponding to the color according to the determined correction pattern width; and performing the ACR on the basis of the transferred pattern.

23. The method as claimed in claim 21, further comprising storing the determined correction pattern width to be used for the ACR.

24. An auto color registration (ACR) method of an image forming apparatus, the method comprising:

transferring, by the image forming apparatus, a pattern corresponding to a color according to a correction pattern width; and performing ACR on the basis of the transferred pattern, wherein the correction pattern width is predetermined according to a light absorbability of the color such that a detected value of a width of the transferred pattern is equal to a predetermined reference value.

25. The method as claimed in claim 24, wherein:

the transferring of the pattern comprises transferring a first pattern corresponding to a first color according to a first correction pattern width and transferring a second pattern corresponding to a second color according to a second correction pattern width;

the performing of the ACR comprises performing the ACR on the basis of the transferred first and second patterns; and the first and second correction pattern widths are predetermined according to a respective light absorbability of the first and second colors such that detected values of widths of the transferred first and second patterns are equal.

* * * * *